US005791873A

United States Patent [19]

Kreitmeier

[11] Patent Number: 5,791,873

[45] Date of Patent: Aug. 11, 1998

[54] MULTI-STAGE BLADE SYSTEM

[75] Inventor: Franz Kreitmeier, Baden, Switzerland

[73] Assignee: Asea Brown Boveri AG, Baden, Switzerland

[21] Appl. No.: 818,978

[22] Filed: Mar. 14, 1997

[30] Foreign Application Priority Data

Apr. 1, 1996 [EP] European Pat. Off. ..... 96810199

[51] Int. Cl.[6] ..... F04D 29/44

[52] U.S. Cl. ..... 415/198.1; 415/199.4; 415/914

[58] Field of Search ..... 415/181, 198.1, 415/199.4, 199.5, 220, 221, 914

[56] References Cited

U.S. PATENT DOCUMENTS 2,392,673 1/1946 Kraft .
2,846,137 8/1958 Smith, Jr. .

FOREIGN PATENT DOCUMENTS 216525 11/1909 Germany .
338916 10/1921 Germany .
579989 7/1933 Germany .
2075130 11/1981 United Kingdom .

*Primary Examiner*—John T. Kwon
*Attorney, Agent, or Firm*—Burns, Doane, Swecker & Mathis, L.L.P.

[57] ABSTRACT

A multi-stage blade system of an axial flow turbo machine includes a wall (10, 11), which is on either the rotor side, the stator side, or both, which bounds the flow through the channel through which flow passes. The wall is provided, immediately at the outlet of the rotor blades (La1, La2, La3), with a kink angle (A, AA). This kink angle (A, AA) is dimensioned such that the outlet flow from the rotor blades is homogenized in terms of the total pressure and outlet flow angle. The wall (10, 11) is also provided with an opposing kink angle (B, BB) at least approximately in the inlet region of the stator blades (Le2, Le3) of the following stage. This allows the labyrinth mass flow to be reduced in blade systems having covering strip sealing.

13 Claims, 3 Drawing Sheets

MULTI-STAGE BLADE SYSTEM

BACKGROUND OF THE INVENTION

1. Field of the Invention

The invention relates to a multi-stage blade system of an axial flow turbo machine. It relates in particular to the design of the channel contour in the blade region and is applicable to blade systems with tip sealing or those with covering plate or covering strip sealing.

2. Discussion of Background

In the case of reaction blade systems, which are subject to vortices, in axial flow turbo machines having cylindrical blades, the changing circumferential component of the flow speed causes a sinuous movement of the path, which is cylinder-projected onto a meridian plane, of a mass particle of the operating medium through the blade system. This rippled flow is described by Walter Traupel in his book "Thermische Turbomaschinen" [Thermal Turbomachines], Volume 1, Springer Press 1966, Chapter 7. In order to reduce the gap losses between the blade system and the boundary walls, it is known, while maintaining this rippled flow, for the boundary on the stator side and the boundary on the rotor side to be provided with approximately the same amount of ripple as that which the flow has. In this case, the ripple shape on the stator side can be formed in such a manner that the contour is directed toward the machine longitudinal axis in the region of the stator blade foot, and is directed away from the machine longitudinal axis in the region of the rotor blade tip. Accordingly, the ripple shape on the rotor side is formed in such a manner that the contour is directed toward the machine longitudinal axis in the region of the stator blade tip, and is directed away from the machine longitudinal axis in the region of the rotor blade foot.

SUMMARY OF THE INVENTION

Accordingly, one object of the present invention is to provide a novel channel contour in the case of a blade system of the aforementioned type, in which channel contour the stage efficiency and the stage load can be increased by geometric measures.

This and other objects are achieved according to the present invention in that the wall which is on the rotor side and/or stator side and bounds the flow of the channel through which flow passes is provided immediately at the outlet of the rotor blades with a kink angle which is dimensioned such that the outlet flow from the rotor blades is homogenized in terms of the total pressure and outlet flow angle, and in that this wall is provided with an opposing kink angle at least approximately in the inlet region of the stator blades of the following stage.

The advantage of this measure can be seen particularly in the fact that at least approximately quasi-repetitive conditions are achieved in the entire blade system, including the first stage.

In the case of blade systems in which the blade ends of the rotor blades seal against the stator via a covering plate which is provided with labyrinths, the wall, which is provided with the kink angle, is advantageously designed at the outlet of the rotor blades as an extension of the covering plate. This also reduces the transverse interchange of flow material which is induced by the pitch-dependent pressure field. Specifically, this may be the cause of separation on the particularly sensitive inlet side of the blades.

The wall which is provided with the opposing kink angle then expediently runs radially inward again in the foot region of the stator blades which are located downstream, after the opposing angle, and is extended at the stator blade outlet, so that the resultant wall which bounds the flow and is interrupted between the extended stator blade foot and the subsequent rotor blade covering plate by an axial gap has a common point with the original straight channel contour at least approximately in the plane of the rotor blade inlet of this following stage.

In the case of blade systems in which the blade ends of the stator blades seal against the rotor via a covering plate which is provided with labyrinths, the wall which is provided with the kink angle is advantageously designed at the outlet of the rotor blades as an extension of the footplate.

The wall which is provided with the opposing kink angle in its inlet region then expediently runs radially inward again on the covering plate of the stator blades which are located downstream, after the opposing kink angle, and is likewise extended at the stator blade outlet. The resultant wall which bounds the flow and is interrupted between the extended stator blade covering plate and the subsequent rotor blade footplate by an axial gap is intended to have a common point with the original straight channel contour at least approximately in the plane of the rotor blade inlet of this following stage.

The extension of the covering strips and of the blade feet downstream leads to a reduction in the transverse interchange of flow material in the cavities there. It is driven by the pitch-dependent pressure field and can lead to separation on the inlet side. The opposing kink angles increase the negative pressure or reduce the positive pressure across the labyrinths, which leads to a reduction in the damaging gap mass flow.

In order to make it harder for flow to enter the labyrinths, the labyrinth inlets between the stator blade feet and the rotor blade covering plates of the same stage and between the rotor blade feet of one stage and the stator blade covering plates of the following stage are directed obliquely in the channel against the general flow direction.

The effect of the labyrinth mass flow reentering the main channel can be improved in that the labyrinth outlets, which open into the axial gap, between the rotor blade covering plates of one stage and the stator blade feet of the subsequent stage as well as between the stator blade covering plates and the rotor blade feet of the same stage run in the general flow direction which prevails in the blade channel. The labyrinth chamber after the last sealing gap is also reduced in size, in order to avoid additional losses.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein the drawings show a plurality of exemplary embodiments of the invention schematically, with reference to low-pressure steam turbines and high-pressure steam turbines. Only those elements which are essential for understanding the invention are shown. The flow direction of the operating media is designated by arrows.

DESCRIPTION OF THE PREFERRED EMBODIMENTS

Figure 1:
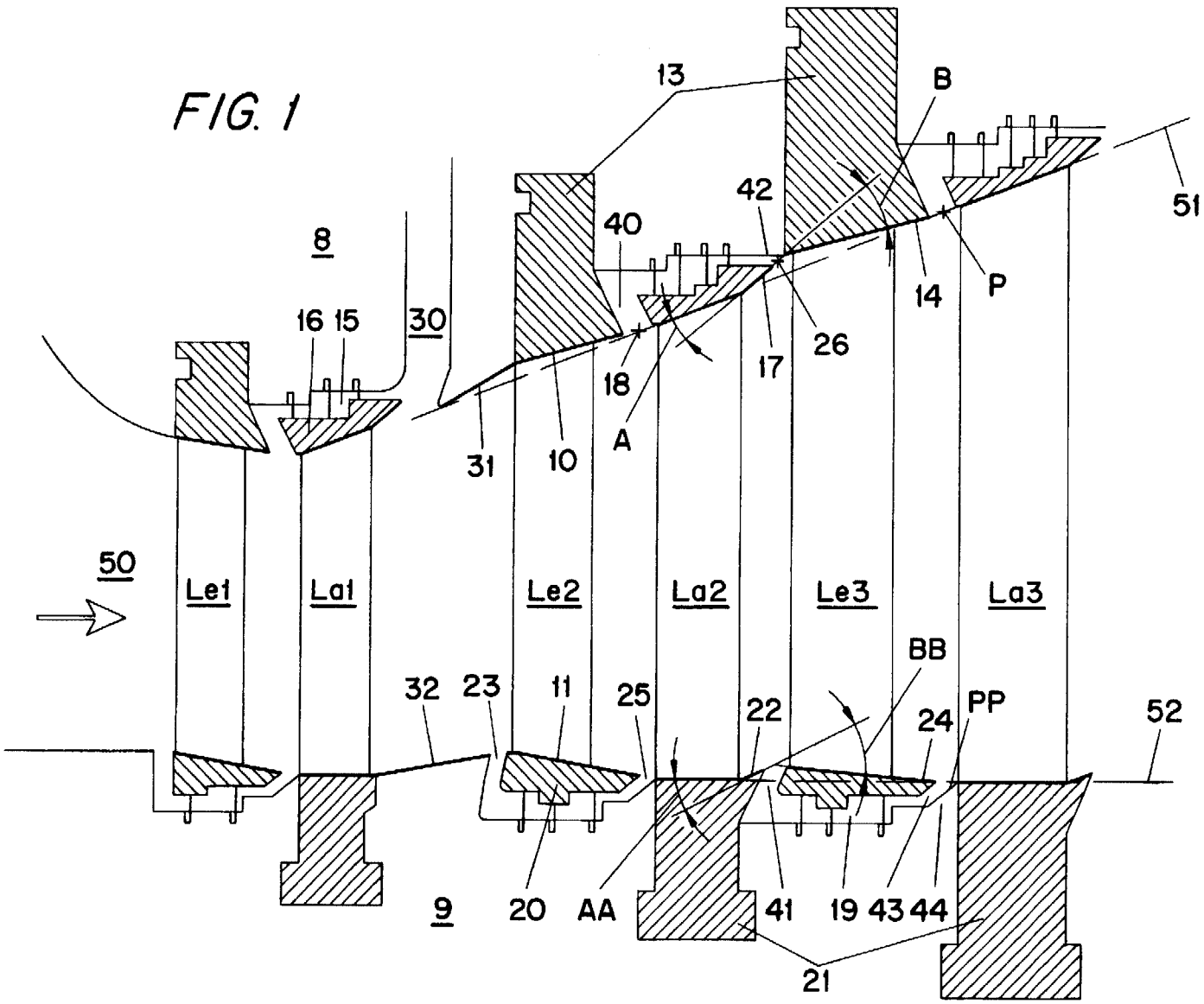
FIG. 1 illustrates a partial longitudinal section of a low-pressure steam turbine with covering plate sealing according to a first embodiment of the present invention.

Referring now to the drawings, wherein like reference numerals designate identical or corresponding parts throughout the several views, the first 3 stages of a low-pressure blade system are illustrated in FIG. 1, these stages each comprising a row of stator blades Le and a row of rotor blades La. The rotor blades La1, La2 whose feet 21 are inserted into recesses in the rotor 9, are provided at their blade ends with covering plates 16. The radially outer contours of the covering plates are set differently, in geometric terms, depending on the row of rotor blades. Their steps seal against sealing strips, which are arranged in a suitable manner in the stator 8, forming labyrinths 15. The stator blades Le1, Le2 and Le3, whose feet 13 are inserted into recesses in the stator 8, are provided at their blade ends with covering plates 20. The radially inner contours of the covering plates are stepped differently in geometric terms, depending on the row of stator blades. Their steps seal against sealing strips, which are arranged in a suitable manner in the rotor 9, forming labyrinths 19. A tap-off 30, which is directed radially outward, is provided in the stator 8, between the first stage and the second stage.

The channel 50 through which flow passes has as the output position the conically running outer contour 51 on the stator and the cylindrically running inner contour 52 on the rotor. Neither of these is absolutely essential. Irrespective of the actual profile of the walls, the outer contour 10, which bounds the flow, is in each case formed in the region of the rotor blade itself by the covering plate 16, which faces channel 50, of the rotor blades La1, La2, La3 and being formed in the region of the stator blade itself by the footplate 13, which faces the channel, of the stator blades Le1, Le2, Le3. In the same way, the inner contour 11, which bounds the flow, of the channel 50 through which flow passes is formed in the region of the rotor blade itself by the footplate 21, which faces the channel, of the rotor blades La1, La2, La3, and in the region of the stator blade itself by the covering plate 20, which faces the channel, of the stator blades Le1, Le2, Le3. Located immediately upstream of the covering plates 16, 20 are axial gaps 18 (on the stator) and 23 (on the rotor) which represent the labyrinth inlets 40 (on the stator) and 41 (on the rotor). Located immediately downstream from these covering plates 16, 20 are axial gaps 26 (on the stator) and 25 (on the rotor) which represent the labyrinth outlets 42 (on the stator) and 43 (on the rotor). As a rule, the gaps are bounded on the other side by stator and rotor parts which carry out the flow guidance in the planes where there are no blades.

According to the invention, the channel 50 is now designed on the stator and/or on the rotor with a kinked contour, the contour being produced as follows:

Initially, both the wall 11 which is on the rotor side and bounds the flow and the wall 10 which is on the stator side of the channel through which flow passes are provided immediately at the outlet of the rotor blades La1, La2, La3 with a kink angle A, AA. This kink angle is dimensioned such that the outlet flow from the rotor blades is homogenized in terms of total pressure and outlet flow angle. In the case of the example, this means that the angles A and AA which are shown are defined as positive both on the stator side and on the rotor side. The kinked wall parts run radially outward, that is to say they are directed away from the machine axis, which is not shown.

The choice of the kink angles is based on the following considerations: The flow is divergent at the outlet from the rotor blades, possibly with an opposing spin on the hub and a spin in the same direction on the cylinder. The flow in the radially outer zone at least has a considerably higher energy than that in the radially inner zone, which manifests itself in the form of considerably higher total pressures in the radially outer zone. Using the kink angle idea, it is now possible to achieve as little inhomogeneity of the total pressure and outlet flow angle as possible over the blade height. The equation for the radial equilibrium teaches that this can be achieved primarily via the meridian curvature of the flow lines. This must therefore be influenced primarily by adaptation of the kink angle. The positive kink angle AA of the inner boundary wall is in principle defined using this consideration, an increase in total pressure being achieved in this region. The same considerations lead to the kink angle profile A on the outer boundary wall. A homogeneous total pressure distribution can be achieved here only if the corresponding kink angle A in each case opens outward with respect to the conical contour of the channel, that is to say likewise assumes a positive value. The desired total pressure reduction in this region is achieved in this way.

Complete implementation of this kink angle idea is predicated on smooth guidance of the flow over a range of a/t=0.5. In this case, "a" means the distance between the rotor blade outlet and the stator blade inlet of the following stage, and "t" means the blade pitch. This results from the knowledge that, when a/t=0.5, the flow inhomogeneities caused by the blade circulation disappear slowly. Smooth guidance of the flow at the rotor blade outlet is therefore difficult. This is because, as mentioned above, the axial gap 26 for the labyrinth outlet 42 is normally located immediately downstream of the covering plate 16, and the axial gap 23 for the labyrinth inlet 41 is normally located downstream of the footplate 21. This is corrected by the measure, on the one hand, of designing the wall 10, which is provided with the kink angle A, at the outlet of the rotor blades as an extension 17 of the covering plate 16. On the other hand, the wall which is provided with the kink angle AA is designed at the outlet of the rotor blades as an extension 22 of the footplate 21. This extends into the axial gap 23 between the extended rotor blade footplate and the following stator blade covering plate 20. Even if the condition a/t=0.5 cannot be implemented completely, measurable results are still also achieved for the correct angle choice with smaller values of a/t. The primary important factor is that the uninterrupted metallic guidance of the kinked wall parts 17 and 22 runs as far as possible, that is to say the axial gaps 26 (outer) and 23 (inner) which follow the wall parts are laid as far as possible downstream of the rotor blade outlet. Particularly in the region of the rotor blade covering plate, the outlet flow, which is extremely important, is thus protected against damaging transverse flow effects.

A particular measure to reduce the labyrinth flow both on the stator and on the rotor is, according to the invention, that the walls 10, 11, which bound the flow, are provided with an opposing kink angle B, BB at least approximately in the inlet region of the stator blades Le2, Le3 of the following stage. This opposing kink expediently starts as early as the gap center of the respective axial gap 26 (outer) and 23 (inner). In accordance with their designation as "opposing" kink angles, the values of the two angles B and BB are in this case negative, that is to say the adjacent wall parts are directed inward, in comparison with the positively kinked wall parts 17 and 22. A pressure increase at the outlet 42 of the labyrinth 15 is at the same time achieved on the outside on the stator. In contrast, a pressure reduction is achieved at the inlet 41 of the labyrinth 19 on the inside on the rotor. Both measures produce a reduced pressure drop across the corresponding labyrinths, and thus lower labyrinth mass flows.

It is now possible to change the double kinked walls back to the original channel contour, further measures being chosen here in order to reduce the labyrinth flow, both on the stator and on the rotor, still further.

On the outside, the wall which is provided with the opposing kink angle B is now guided radially inward again in the foot region of the stator blades Le2, Le3, which are located downstream, after the opposing kink angle. Furthermore, they are provided with an extension 14 at the stator blade outlet. The radially inward profile is chosen such that the resultant wall, which bounds the flow and is interrupted between the extended stator blade foot and the subsequent rotor blade covering plate 16 by the axial gap 18, has an intersection P with the original straight channel contour 51 at least approximately in the plane of the rotor blade inlet of this following stage. It can be seen from the drawing that the extension 14 forms a positive angle, which is open outward, again with the original channel contour 51, which exists on the side, facing the channel, of the covering plate 16 of the following rotor blades. This kink point is also expediently moved to the center of the axial gap 18. This results in a pressure reduction at the inlet 40 of the labyrinth 15. This pressure reduction at the labyrinth inlet produces a reduction in the pressure drop across the sealing points, in the same way as the pressure increase at the labyrinth outlet.

A corresponding procedure is adopted on the inside, on the hub. The wall, which is provided with the opposing kink angle BB in its inlet region, runs radially inward again on the covering plate 20 of the stator blades, after the opposing kink angle. It is also provided with an extension 24 at the stator blade outlet. The resultant wall which bounds the flow and is interrupted between the extended stator blade covering plate and the subsequent rotor blade footplate 21 by an axial gap 25 is directed such that it has a common point PP with the original straight channel contour 52, at least approximately in the plane of the rotor blade inlet. It can once again be seen from the drawing that the extension 24 once again forms a positive angle, which is open outward, with the original channel contour 52 which exists on the side, facing the channel, of the footplate 21 of the following rotor blades. This kink point is also advantageously moved to the center of the axial gap 25. This results in a pressure increase at the outlet 43 of the labyrinth 19. This pressure increase at the labyrinth outlet produces a reduction in the pressure drop across the sealing points, in the same way as the pressure reduction at the labyrinth inlet.

The channel design described so far now offers the possibility of a further reduction in the labyrinth flow.

As a result of the fact that the footplate 13 of the stator blades is provided on the stator side with an extension 14, the labyrinth inlets 40 between the stator blade feet 13 and the rotor blade covering plates 16 in the same stage can be directed obliquely against the general flow direction in the channel. To do this, all that is needed is for the footplate of the stator blades to be configured appropriately on the outlet side, and the covering strip of the rotor blades to be configured appropriately on the inlet side. This oblique positioning of the inlet makes it harder for flow to enter the labyrinth 15.

Since, in an analogous manner to this, the footplate 21 of the rotor blade is provided on the rotor side with an extension 22, the labyrinth inlets 41 between the rotor blade feet 21 and the stator blade covering plates 20 of the following stage can also be directed obliquely against the general flow direction in the channel. To do this, all that is needed is for the footplate of the rotor blades to be configured appropriately on the outlet side, and the covering strip of the stator blades to be configured appropriately on the inlet side. This oblique positioning of the inlet makes it harder for flow to enter the labyrinth 19.

Furthermore, measures are adopted which considerably improve the reentry flow of the labyrinth mass flow.

Thus, on the one hand, the labyrinth outlet 42 which opens into the axial gap 26 runs on the outside between the rotor blade covering plate 16 of one stage and the stator blade foot 13 of the subsequent stage in the general flow direction which prevails in the channel 50. The labyrinth outlet 42 is kept radially as small as possible in order to avoid unnecessary dissipation. As a result of the extension 17 of the covering plate, the outward flow from the labyrinth can take place as close as possible to the following stator blade inlet.

In the same way, the labyrinth outlet 43 which opens into the axial gap 25 also runs on the inside between the stator blade covering plate 20 and the rotor blade foot 21 of the same stage obliquely in the general flow direction which prevails in the channel 50. In order to avoid damaging vortex chambers, in which energy could be dissipated, at the outlet of the labyrinths 43, the rotor part is provided at appropriate points with projections 44, which permit an outlet which is favorable in flow terms.

Special precautions must be taken in the plane of the tap-off point 30 mentioned above. The wall 31 which bounds the flow of the stator immediately upstream of the stator blades Le2 is designed as part of the wall which is provided with the opposing kink angle B. On the rotor side, the wall 32, which bounds the flow, of the rotor 9 immediately downstream of the rotor blades La1 can be designed in the plane of the tap-off point 30 as a wall which is provided with the kink angle AA.

Figure 2:
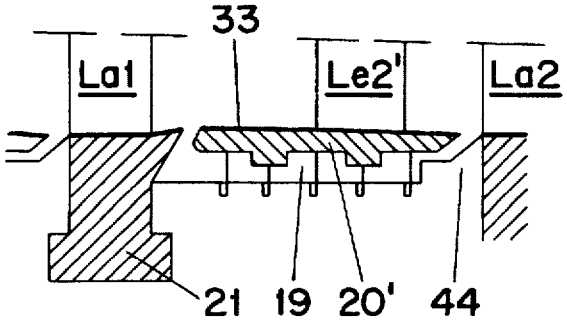
FIG. 2 illustrates a design variant of the rotor part in the plane of a tap-off point which is arranged in the stator according to a second embodiment of the present invention.

FIG. 2 illustrates a design variant according to a second embodiment of the present invention. Here, on the rotor side, the rotor blades La1 are equipped in the plane of the tap-off point 30 with the extension 22 described above, while the covering plate 20' of the stator blades Le2 which are located downstream are provided with an extension 33 on the inlet side, which also comprises the part with the opposing kink angle BB.

Figure 3:
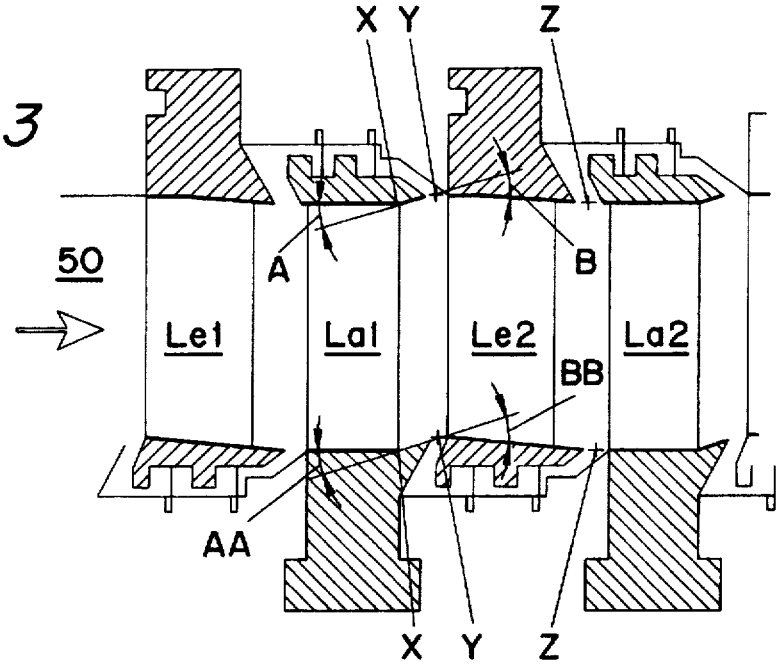
FIG. 3 illustrates a partial longitudinal section of a turbine having covering plate sealing according to a third embodiment of the present invention.

FIG. 3 illustrates the application of the invention according to a third embodiment of the present invention, a high-pressure blade system with covering plate sealing, in which the channel 50 through which flow passes has only very weak conicity. 2 stages are shown, each having one row of stator blades Le and one row of rotor blades La. Elements having the same function are provided with the same reference designations as in FIG. 1. The 3 kink points X, Y, Z can be seen both on the outside of the cylinder and on the inside of the hub. At the bend points X, the walls 10 and 11 run with kink angles A and AA respectively; at the kink points Y, they have the opposing kink angles B and BB, respectively. The kink points Y and Z are once again advantageously moved to the respective gap center. It is furthermore possible to see that the other measures described above, such as the inclines of the labyrinth inlets, which are not designated in any more detail, and the flow-control design of the labyrinth outlets can also be implemented in such a blade system.

Figure 4:
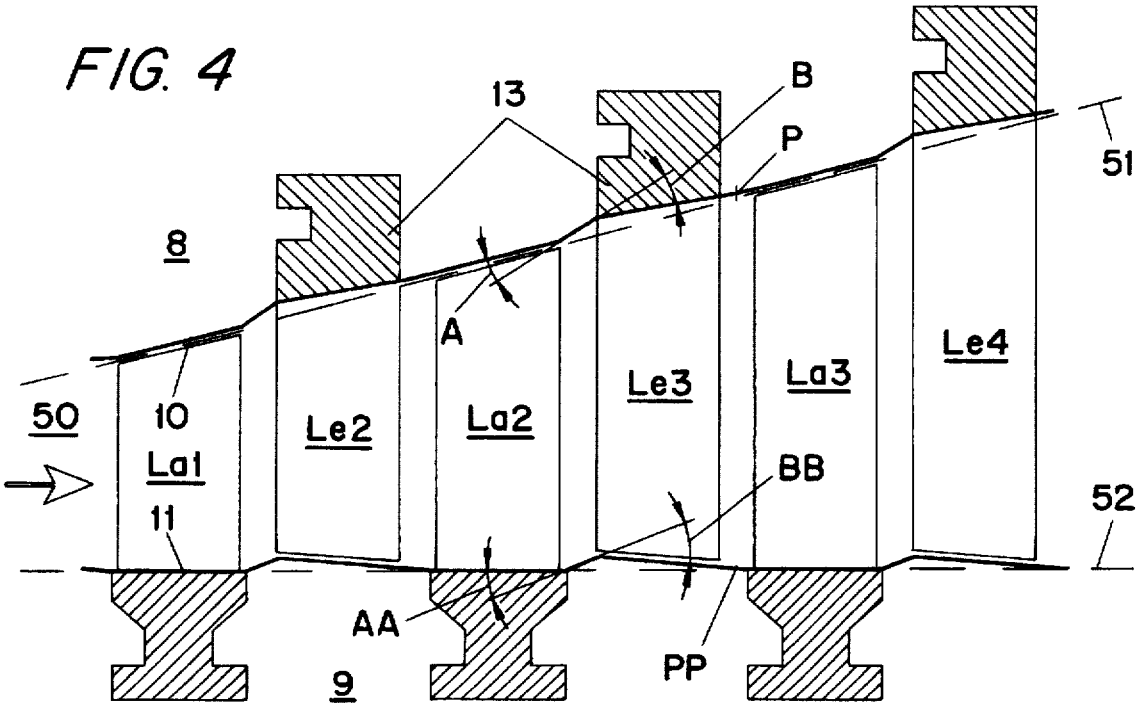
FIG. 4 illustrates a partial longitudinal section of a turbine having tip sealing according to a fourth embodiment of the present invention.

FIG. 4 illustrates the application of the invention according to a fourth embodiment of the present invention, a blade system in which the blade ends of the rotor blades La1, La2, La3 seal with the tip against the walls 10, which bound the flow, of the channel 50 through which flow passes. Outside the region of the blades, these walls 10 are formed by the inner wall on the channel side of the stator. The longitudinal extent of the wall, which is provided with the positive kink angle A, at the rotor blade outlet of the stage under consideration initially runs radially outward in the opening direction. The wall which is provided with the negative opposing kink angle B is formed on the stator side by the footplates 13, which face the channel through which flow passes, of the stator blades Le2, Le3, Le4 of the following stage. After the wall part which is provided with an opposing kink angle, the wall runs radially inward such that it has a common point P with the original straight outer channel contour 51 at least approximately in the plane of the rotor blade inlet of this following stage.

The blade ends of the stator blades Le2, Le3, Le4 also seal with the tip against the walls 11 which bound the flow of the channel 50 through which flow passes. On the rotor side, the wall 11 which is provided with the kink angle AA and the opposing kink angle BB is formed from the rotor surface. The longitudinal extent of the wall which is provided with the positive kink angle AA initially runs radially outward at the rotor blade outlet of the stage under consideration. After the opposing kink angle, the wall which is provided with the negative opposing kink angle BB runs such that it has a common point PP with the original straight channel contour 52 at least approximately in the plane of the rotor blade inlet of this following stage.

Figure 5:
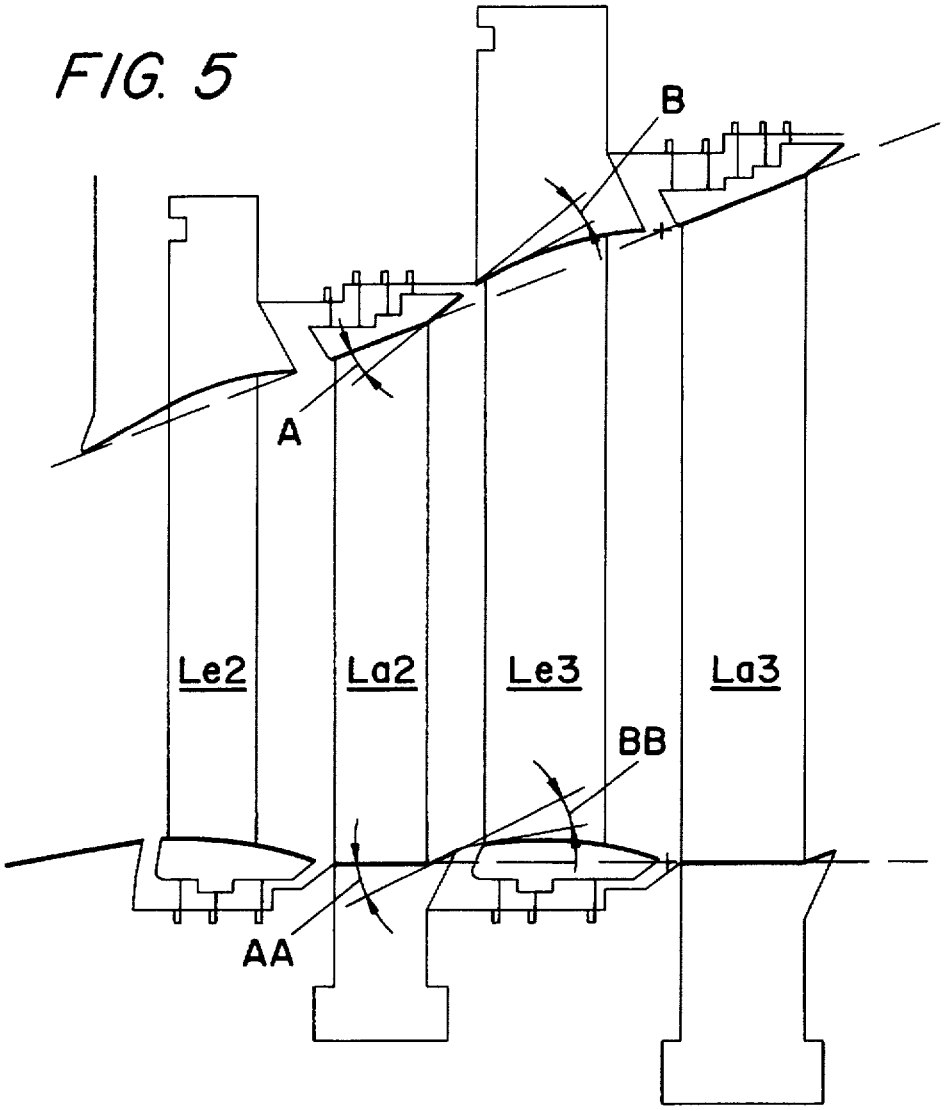
FIG. 5 illustrates a partial longitudinal section of a low-pressure steam turbine according to FIG. 1, with a channel contour variant according to a fifth embodiment of the present invention.

FIG. 5 illustrates the 2 last stages of the low-pressure turbine which is illustrated in FIG. 1, with a design variant of the channel contour according to a fifth embodiment of the present invention. The opposing kink angles are in this case reduced by introducing curved contours in the region of the stator blades. These curved contours make it possible to achieve a reduction in the positive pressure at P and an increase in the negative pressure at PP.

The invention is, of course, not limited to the exemplary embodiments shown and described. The inventive idea optionally can, for example, be implemented only on the stator or—in the case of a covering plate blade system—only after the rows of rotor blades if, for example, there are space problems. In principle, the present invention is applicable to all turbo machines. In the previous examples, it has been assumed that the total pressure increases from the hub to the cylinder. The total pressure profile may be different, depending on the basic design or operating point for which the blade system is optimized. The governing factor in each case is that the total pressure profile and the outlet flow angle profile can be influenced in a positive manner by arranging correctly dimensioned and directed kink angles in the meridian contour after the rotor disks, positive in this case indicating homogenization. The aim in this case is to achieve undisturbed wall surfaces with a minimum length of a/t=0.5. If this is implemented, then, in addition to the desired total pressure homogenization, a further achievement is that the flow field, which is highly inhomogeneous at the rotor blade outlet because of circulation, is screened against damaging transverse influences.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A multi-stage blade system of an axial flow turbomachine, comprising:

a first stage rotor blade having an outlet, a following stage stator blade having an inlet, a channel including an upstream end and a downstream end through which flow can pass, and a first wall which bounds the flow through said channel, said first wall including a first kink angle provided immediately at said outlet of said first stage rotor blade which is dimensioned to substantially homogenize the total pressure and outlet flow angle of the outlet flow from said channel;

wherein said first wall is further provided with a first opposing kink angle adjacent said inlet of said following stage stator blade.

2. The multi-stage blade system according to claim 1, further comprising a following stage rotor blade including an inlet, wherein said first stage rotor blade further comprises a blade end which seals against said first wall; wherein said following stage stator blade further comprises a footplate facing said channel, and said first opposing kink angle is formed on a portion of said footplate, said first wall continuing past said first opposing kink angle such that it has a common point with a first original straight outer channel contour approximately coplanar with said following stage rotor blade inlet.

3. The multi-stage blade system according to claim 2, further comprising a rotor surface and a second wall, and wherein said following stage stator blade further comprises a blade end which seals against said second wall;

wherein said second wall is further provided with a second kink angle and a second opposing kink angle formed on said rotor surface;

wherein a portion of said first wall adjacent said first stage rotor blade outlet runs radially outward; and wherein said second wall runs after said second opposing kink angle such that it has a common point with a second original straight channel contour approximately coplanar with said following stage rotor blade inlet.

4. The multi-stage blade system according to claim 1, further comprising a stator, wherein said following stage stator blade further comprises a footplate, and wherein said first stage rotor blade further comprises a covering plate which seals against said stator, said first stage rotor blade covering plate provided with labyrinths, a portion of said first wall being formed adjacent said first stage rotor blade by said first stage rotor blade covering plate, said first stage rotor blade covering plate facing said channel, a portion of said first wall being formed adjacent said following stage stator blade by said following stage stator blade footplate, said following stage stator blade footplate facing said channel, wherein said first stage rotor blade covering plate further comprises an extension adjacent said first stage rotor blade outlet which comprises a portion of said first wall.

5. The multi-stage blade system according to claim 4, further comprising a following stage rotor blade including an inlet, said following stage stator blade further comprising an outlet, and wherein said first wall runs radially inward after said first opposing kink angle and adjacent said following stage stator blade footplate, and wherein said following stage stator blade footplate further comprises an extension adjacent said following stage stator blade outlet, said following stage stator blade footplate extension comprising a portion of said first wall, said first wall having a common point with a first original straight channel contour approximately coplanar with said following stage rotor blade inlet.

6. The multi-stage blade system according to claim 4, further comprising a tap-off point in said stator directed approximately radially and arranged in a region between said first stage rotor blade and said following stage stator blade;

wherein a portion of said first wall immediately upstream of said following stage stator blade further comprises said first opposing kink angle.

7. The multi-stage blade system according to claim 1, further comprising a rotor and a second wall which bounds the flow through said channel, wherein said first stage rotor blade further comprises a footplate which faces said channel, said following stage stator blade further comprises a covering plate which faces said channel and which seals against said rotor, said following stage stator blade covering plate provided with labyrinths, a portion of said second wall being formed by said first stage rotor blade footplate, a portion of said second wall being formed by said following stage stator blade covering plate wherein said first stage rotor blade footplate further comprises an extension adjacent said first stage rotor blade outlet and extending toward said following stage stator blade covering plate, said second wall further comprises a second kink angle adjacent said first stage rotor blade outlet.

8. The multi-stage blade system according to claim 7, further comprising a following stage rotor blade including and inlet and a footplate, wherein said second wall further comprises a second opposing kink angle, said second wall runs radially inward at said following stage stator blade covering plate after said second opposing kink angle, and wherein said following stage stator blade covering plate further comprises an extension adjacent said following stage stator blade outlet; wherein said second wall is interrupted between said following stage stator blade covering plate extention and said following stage rotor blade footplate by an axial gap, said second wall having a common point with a second original straight channel contour approximately coplanar with said following stage rotor blade inlet.

9. The multi-stage blade system according to claim 6, further comprising a second wall which bounds the flow through said channel, said second wall including a second kink angle subtantially coplanar with said tap-off point and immediately downstream of said first stage rotor blade.

10. The multi-stage blade system according to claim 6, wherein said following stage stator blade further comprises a covering plate including an extension, which extension is adjacent said following stage stator blade inlet and substantially coplanar with said tap-off point.

11. The multi-stage blade system according to claim 5, further comprising an inlet to said first stage rotor blade covering plate labrynths, said following stage stator blade covering plate further comprising labrynths having an inlet, said inlets directed at least partially upstream.

12. The multi-stage blade system according to claim 5, further comprising a first stage rotor blade footplate and a first stage stator blade including a covering plate, said first stage stator blade covering plate having labrynths and a labrynth outlet, and further comprising an outlet from said first stage rotor blade labrynths which opens between said first stage rotor blade covering plate and said following stage stator blade footplate, said first stage stator blade covering plate labrynth outlet opens between said first stage stator blade covering plate and said first stage rotor blade footplate at least partially downstream.

13. The multi-stage blade system according to claim 12, wherein said labyrinth outlets are constricted.

* * * * *